US008556253B2

(12) United States Patent
Okazaki

(10) Patent No.: US 8,556,253 B2
(45) Date of Patent: Oct. 15, 2013

(54) SHEET FEEDING APPARATUS AND IMAGE FORMING APPARATUS

(75) Inventor: Shunsuke Okazaki, Mishima (JP)

(73) Assignee: Canon Kabushikia Kaisha, Tokyo (JP)

( * ) Notice: Subject to any disclaimer, the term of this patent is extended or adjusted under 35 U.S.C. 154(b) by 0 days.

(21) Appl. No.: 13/555,498

(22) Filed: Jul. 23, 2012

(65) Prior Publication Data

US 2013/0026701 A1 Jan. 31, 2013

(30) Foreign Application Priority Data

Jul. 29, 2011 (JP) ..... 2011-167584

(51) Int. Cl.
*B65H 1/22* (2006.01)

(52) U.S. Cl.
USPC ..... 271/164; 271/147; 271/162

(58) Field of Classification Search
USPC ..... 271/145, 147, 162, 164
See application file for complete search history.

(56) References Cited

U.S. PATENT DOCUMENTS

| | | | | |
|---|---|---|---|---|
| 4,030,725 | A * | 6/1977 | Fukui et al. | 271/164 |
| 4,494,746 | A * | 1/1985 | Moser | 271/164 |
| 5,292,116 | A * | 3/1994 | Inoue et al. | 271/157 |
| 7,753,607 | B2 * | 7/2010 | Tan et al. | 400/624 |
| 7,862,034 | B2 * | 1/2011 | Kobayashi | 271/145 |
| 2006/0071403 | A1 * | 4/2006 | Bingham et al. | 271/145 |
| 2006/0157916 | A1 * | 7/2006 | Ahn et al. | 271/145 |
| 2007/0120319 | A1 * | 5/2007 | Park | 271/162 |
| 2009/0166956 | A1 * | 7/2009 | Kajiyama | 271/164 |
| 2012/0256367 | A1 | 10/2012 | Matsushima et al. | |

FOREIGN PATENT DOCUMENTS

| | | | |
|---|---|---|---|
| JP | 57038236 | A * | 3/1982 |
| JP | 58017061 | A * | 2/1983 |
| JP | 2008-050081 | A | 3/2008 |

* cited by examiner

*Primary Examiner* — Prasad Gokhale
(74) *Attorney, Agent, or Firm* — Fitzpatrick, Cella, Harper & Scinto

(57) ABSTRACT

The sheet feeding apparatus includes an apparatus body, a sheet cassette, a positioning member which includes a positioning pin arranged at one of the apparatus body and the sheet cassette and a positioning hole arranged at the other of the apparatus body and the sheet cassette and which performs positioning of the sheet cassette owing to fitting of the positioning pin with the positioning hole when the sheet cassette is slidingly moved to an attached position, and a restriction member which performs restriction of movement of the sheet cassette in the horizontal direction being perpendicular to a sliding direction from a drawn position to a fitting beginning position where fitting of the positioning member begins and which releases restriction of the movement of the sheet cassette in the horizontal direction from the fitting beginning position to the attached position.

12 Claims, 14 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and in particular, relates to a sheet feeding apparatus having a sheet cassette in which sheets are stacked and an image forming apparatus having the sheet feeding apparatus.

2. Description of the Related Art

Conventionally, an image forming apparatus such as a copying machine and a printer is structured to include a sheet feeding portion to feed a sheet to an image forming portion. Such a sheet feeding portion includes a plurality of sheet cassettes in which various sizes of sheets are stored.

As disclosed in Japanese Patent Laid-Open No. 2008-50081, such a plurality of sheet cassettes respectively includes a guided member as being slidable against a guide member arranged at an apparatus body. Then, sliding movement of the sheet cassettes to the apparatus body is smoothed by arranging a sliding member at the guided member, so that sheet cassette operability for attaching and detaching is improved.

Here, FIG. 14 illustrates a state that the sheet cassette is to be attached to a feeding apparatus body according to Japanese Patent Laid-Open No. 2008-50081. In a case that a sheet cassette 100 is rotated in a direction of arrow Y during attaching and detaching, there is a fear that the sheet cassette 100 is damaged as being contacted to an external cover and a structural member located therearound. Accordingly, as illustrated in FIG. 14, in the sheet feeding apparatus disclosed in Japanese Patent Laid-Open No. 2008-50081, the rotation of the sheet cassette 100 in the direction of arrow Y during attaching and detaching is limited into an established angle by arranging side rollers 102 at lateral ends of an inner rail 101 in the horizontal direction. Further, at the inside of the apparatus body 110, positioning rollers 112 are arranged at both end sides of an outer rail 111 in the horizontal direction. Positioning of the sheet cassette 100 inside the apparatus body 110 is performed by the positioning rollers 112.

Here, in the light of positional variation of the positioning rollers 112 arranged at the apparatus body 110, sliding resistance is generated for performing positioning of the sheet cassette 100 when a clearance between the side roller 102 and the outer rail 111 is lessened. In particular, a large volumetric sheet cassette causes large sliding resistance as a result of large dimensions of structural members. When the sliding resistance becomes large, operational force required for attaching and detaching the sheet cassette becomes large. Accordingly, there is a fear that operability thereof is decreased.

The present invention provides a sheet feeding apparatus capable of reliably restricting movement of a sheet cassette in the horizontal direction without decreasing operability of the sheet cassette and an image forming apparatus having the sheet feeding apparatus.

SUMMARY OF THE INVENTION

According to the present invention, there is provided a sheet feeding apparatus, including an apparatus body, a sheet cassette which stores sheets and is arranged slidably between an attached position for feeding the sheet and a drawn position where being drawn from the apparatus body, a positioning member which includes a fitting projection arranged at one of the apparatus body and the sheet cassette and a fitting hole arranged at the other of the apparatus body and the sheet cassette and which performs positioning of the sheet cassette to the apparatus body to fit the fitting projection with the fitting hole when the sheet cassette is slidingly moved to the attached position, and a restriction member which performs restriction of movement of the sheet cassette in the horizontal direction being perpendicular to a sliding direction from the drawn position to a fitting beginning position where fitting of the positioning member begins when the sheet cassette is slidingly moved and which releases restriction of the movement of the sheet cassette in the horizontal direction from the fitting beginning position to the attached position.

According to the present invention, movement of a sheet cassette in the horizontal direction can be reliably restricted without decreasing operability of the sheet cassette by releasing restriction of the sheet cassette in the horizontal direction when the sheet cassette is located at an attached position.

Further features of the present invention will become apparent from the following description of exemplary embodiments with reference to the attached drawings.

DESCRIPTION OF THE EMBODIMENTS

In the following, an image forming apparatus according to embodiments of the present invention will be described with reference to the drawings.

The image forming apparatus according to the embodiments of the present invention is an image forming apparatus, such as a copying machine, a printer, a facsimile machine, and a multi-function machine thereof, provided with a sheet feeding apparatus in which a plurality of sheet cassettes can be attached to an image forming apparatus body. In the following embodiments, description will be performed on an image forming apparatus provided with a sheet feeding apparatus including two sheet feeding units at the right and left viewing from the apparatus front.

Figure 1:
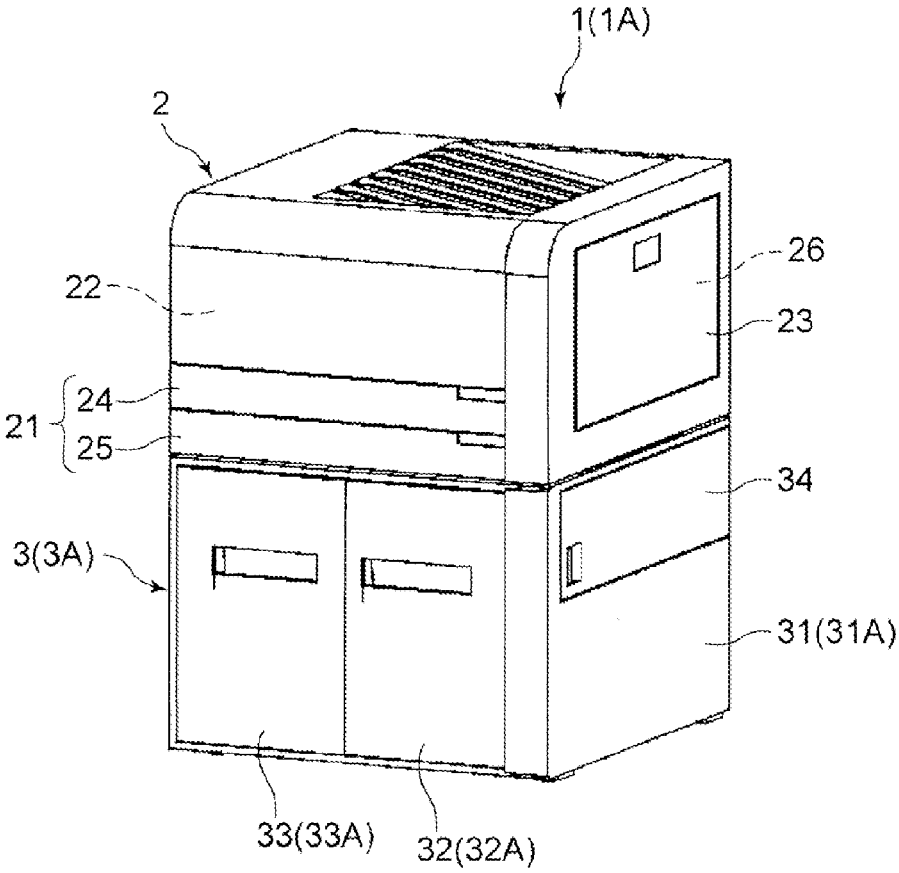
FIG. 1 is a perspective view schematically illustrating an image forming apparatus according to an embodiment of the present invention.
Figure 2:
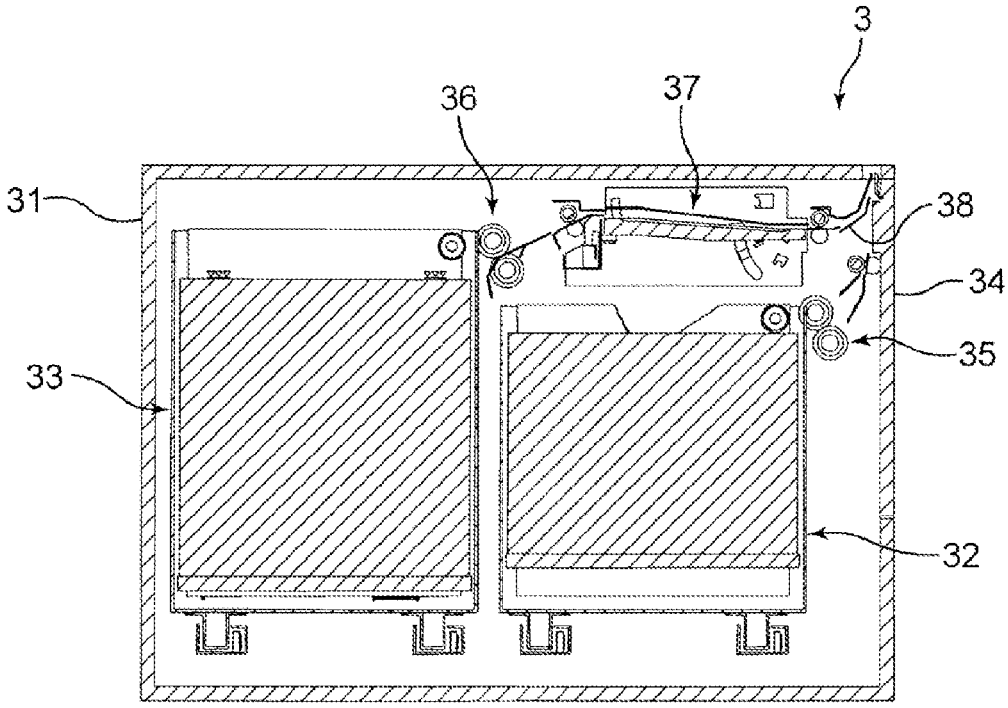
FIG. 2 is a sectional view schematically illustrating a sheet feeding apparatus according to the present embodiment.

<First Embodiment>An image forming apparatus 1 according to a first embodiment of the present invention will be described with reference to FIGS. 1 to 8B. First, an overall structure of the image forming apparatus 1 according to the first embodiment will be described with reference to FIGS. 1 and 2. FIG. 1 is a perspective view schematically illustrating the image forming apparatus 1 according to the present embodiment. FIG. 2 is a sectional view schematically illustrating a sheet feeding apparatus 3 according to the present embodiment.

As illustrated in FIG. 1, the image forming apparatus 1 includes an image forming apparatus body 2 which forms an image on a sheet S and a sheet feeding apparatus 3 which feeds a sheet S to an image forming portion 22 of the image forming apparatus body as being connected to a lower part of the image forming apparatus body 2. The image forming apparatus body 2 includes a sheet feeding portion 21 which feeds a sheet S, the image forming portion 22 which forms an image on a sheet S, and a first open-close cover 23 which is supported by the image forming apparatus body 2 in an openable and closable manner. The sheet feeding portion 21 includes a first sheet cassette 24 and a second sheet cassette 25 arranged one above another in two stages and selectively feeds sheets stored in the first sheet cassette 24 and the second sheet cassette 25 to the image forming portion 22. The image forming portion 22 forms an image on a sheet S fed from the sheet feeding portion 21. In the present embodiment, the image forming portion 22 being an electrophotographic system forms an image on a sheet by transferring a toner image formed on a photosensitive member onto a sheet at a transfer portion fed from a sheet feeding portion 21 or the sheet feeding apparatus 3 and thermally fixing the transferred toner image. The first open-close cover 23 is formed as being capable of opening a sheet conveying path 26 which connects the sheet feeding portion 21 and the image forming portion 22 so that jam recovery can be easily performed in a case that a sheet S is jammed while passing through the sheet conveying path 26.

The sheet feeding apparatus 3 is connected to the sheet conveying path 26 of the image forming apparatus body 2 and feeds sheets S stored in a right sheet cassette 32 and a left sheet cassette 33 which are described later to the image forming portion 22 of the image forming apparatus body 2 via the sheet conveying path 26. As illustrated in FIG. 2, the sheet feeding apparatus 3 includes a feeding apparatus body 31, the right sheet cassette 32 and the left sheet cassette 33 in which sheets S are stacked, and a second open-close cover 34. Further, the sheet feeding apparatus 3 includes a right feeding portion 35 and a left feeding portion 36 which feeds sheets stacked in the right sheet cassette 32 and the left sheet cassette 33 one by one, a conveying portion 37 which conveys a sheet fed from the left feeding portion 36, and a conveying guide 38.

In the feeding apparatus body 31, the right sheet cassette 32 and the left sheet cassette 33 which are approximately box-shaped are arranged in a detachably attachable manner. Replacement and replenishment of sheets are performed by a user after drawing the right sheet cassette 32 and the left sheet cassette 33. The second open-close cover 34 is formed as being capable of opening a merging section between the right feeding portion 35 and the conveying portion 37 and is used for performing jam recovery at the right feeding portion 35 and the conveying portion 37. The right feeding portion 35 is arranged at a right-upper part of the right sheet cassette 32 and feeds sheets S stacked in the right sheet cassette 32 one by one to the sheet conveying path 26 of the image forming apparatus body 2. The left feeding portion 36 is arranged at a right-upper part of the left sheet cassette 33 and feeds sheets stacked in the left sheet cassette 33 one by one to the conveying portion 37. The conveying portion 37 is arranged above the right sheet cassette 32 and feeds a sheet conveyed by the left feeding portion 36 to the sheet conveying path 26 of the image forming apparatus body 2. The conveying guide 38 is arranged at a position beside the conveying portion 37 and above the right feeding portion 35. The conveying guide 38 is supported by the feeding apparatus body 31 as being rotatable between a guide position and a release position about a rotary shaft (not illustrated) extended in the horizontal direction. The conveying guide 38 guides the sheets S to be fed to the sheet conveying path 26 by the right feeding portion 35 and the conveying portion 37.

Here, the feeding apparatus body 31, the right sheet cassette 32 and the left sheet cassette 33 will be described more specifically with reference to FIGS. 3 to 8B. First, the respective overall structures will be described with reference to FIGS. 3 to 5. In the following, since the right sheet cassette 32 and the left sheet cassette 33 basically have the same structure, the right sheet cassette 32 and the left sheet cassette 33 are described as a sheet cassette 4. Further, the feeding apparatus body 31 is described as an apparatus body 5 to which the sheet cassette 4 is detachably attachable.

Figure 3:
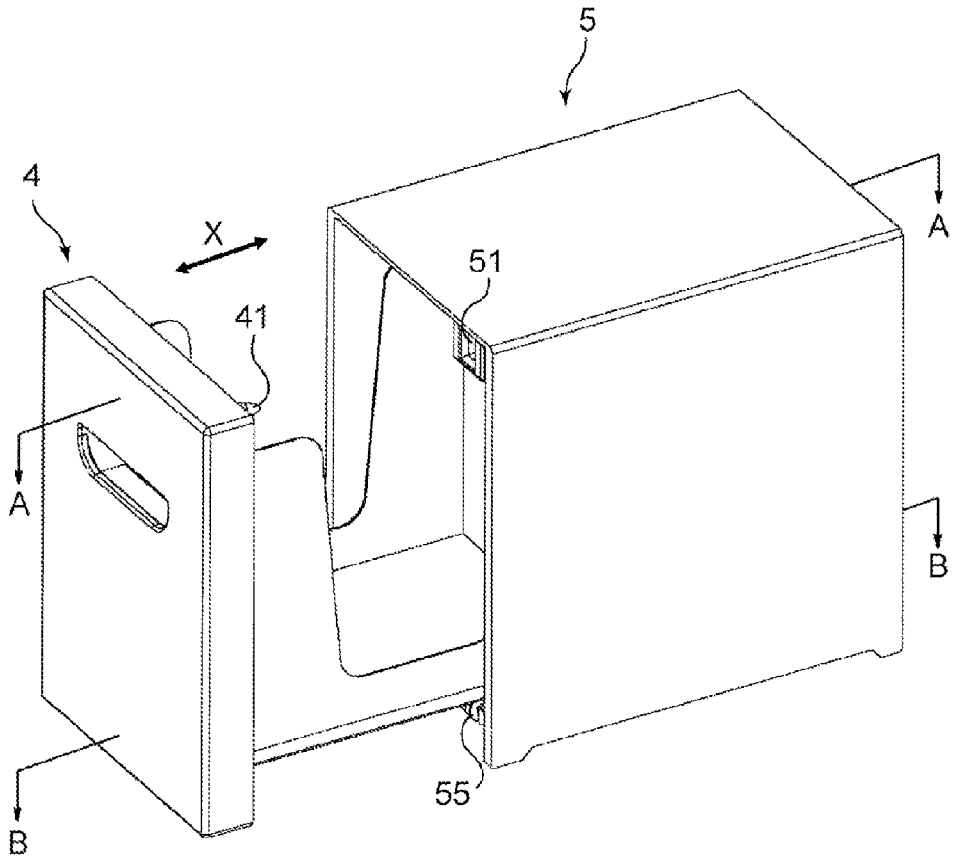
FIG. 3 is a perspective view illustrating a state that the sheet cassette is drawn from the apparatus body according to the present embodiment.
Figure 4A:
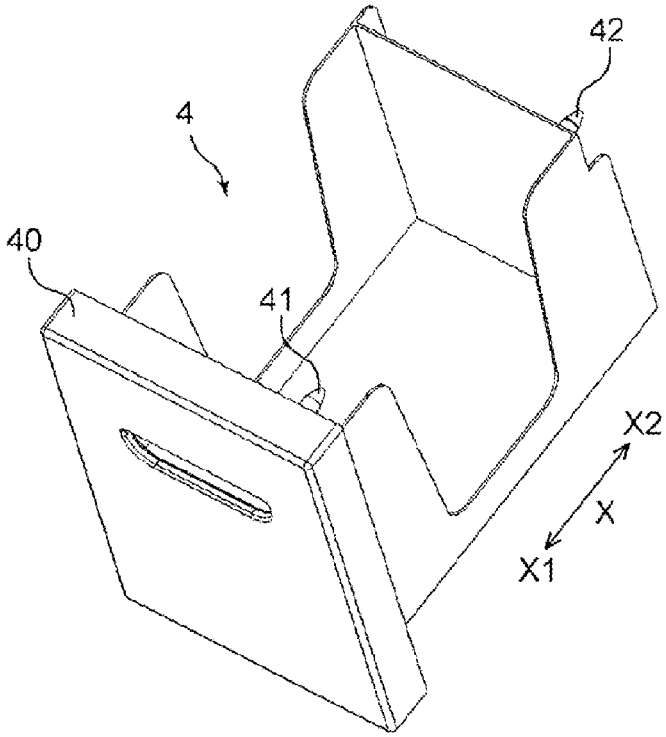
FIG. 4A is a perspective view of a sheet cassette according to a first embodiment viewing from above.
Figure 4B:
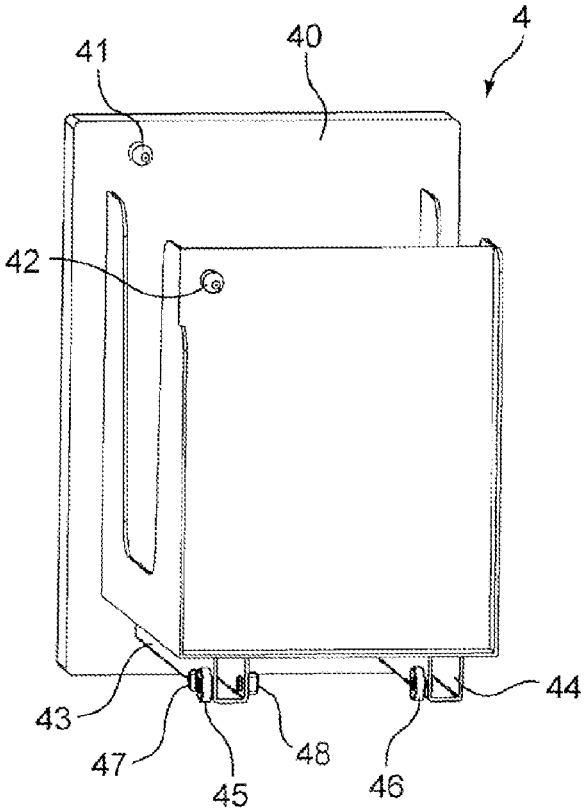
FIG. 4B is a perspective view of the sheet cassette viewing from behind.
Figure 5:
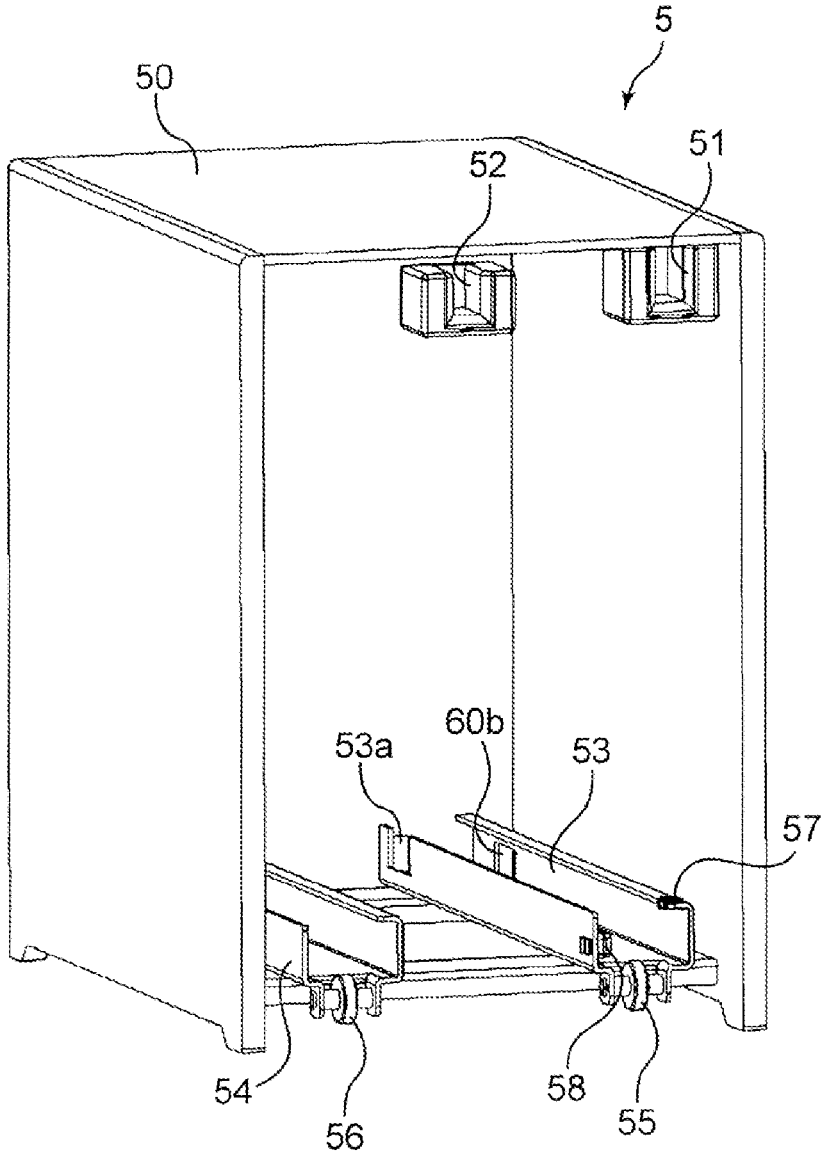
FIG. 5 is a perspective view schematically illustrating a part of an internal structure of an apparatus body according to the first embodiment.

FIG. 3 is a perspective view illustrating a state that the sheet cassette 4 is drawn from the apparatus body 5 according to the present embodiment. FIG. 4A is a perspective view of the sheet cassette 4 according to the first embodiment viewing from above. FIG. 4B is a perspective view of the sheet cassette 4 viewing from behind. FIG. 5 is a perspective view schematically illustrating a part of an internal structure of the apparatus body 5 according to the first embodiment.

As illustrated in FIG. 3, the sheet cassette 4 is formed slidably against the apparatus body 5 in a direction of arrow X illustrated in FIG. 3 (hereinafter, called a "sliding direction X"). Specifically, the sheet cassette 4 is attached to the inside of the apparatus body 5 and is formed to be slidable between an attached position for feeding a sheet S and a drawn position where being drawn from the apparatus body 5.

As illustrated in FIGS. 4A and 4B, the sheet cassette 4 includes a cassette body 40 which stores sheets S, a first positioning pin 41 and a second positioning pin 42 as a fitting projection of a positioning member, and inner rails 43, 44 as a guide member of a restriction member.

Further, the sheet cassette 4 includes inner bearings 45, 46 and inner spacers 47, 48 as a guided member of the restriction member.

As illustrated in FIG. 4A, the cassette body 40 is formed into a rectangular box shape of which upper face is opened so that sheets S can be stacked at the inside thereof. The first positioning pin 41 is arranged at the front side X1 of the cassette body 40 in the sliding direction X and the second positioning pin 42 is arranged at the back side X2 of the cassette body 40 in the sliding direction X. In the first embodiment, the positioning pins are arranged respectively at the front and back of the cassette body 40 in the sliding direction X.

As illustrated in FIG. 4B, the inner rails 43, 44 are arranged at a bottom face of the cassette body 40 as being extended in the sliding direction X and are slidably engaged with later-mentioned outer rails 53, 54. Further, first hole portions 61*a*, 61*b* are formed at the inner rail 43 at the front side X1 in the sliding direction X as a release portion of the restriction member (see FIG. 8B described later). The first hole portions 61*a*, 61*b* are formed to have size of dimensions in the sliding direction X to prevent the outer spacers 57, 58 from being guided (restricted) by the inner rail 43 in a range from a position (fitting beginning position) where the first positioning pin 41 and the second positioning pin 42 begin fitting with a first positioning hole 51 and a second positioning hole 52 to a fitting completed position. That is, the size of the first hole portions 61*a*, 61*b* in the sliding direction X is set in accordance with a movement amount of the cassette body 40 from the fitting beginning position to the fitting completed position of the first and second positioning pins 41, 42 with the first and second positioning holes 51, 52. Slopes 43*a*, 43*b* are formed at the back side X2 in the sliding direction X from the first hole portions 61*a*, 61*b*. The slopes 43*a*, 43*b* are arranged as being expanded to the front side X1 in the sliding direction X so as to prevent the cassette body 40 from being locked as the outer spacers 57, 58 getting stuck with the inner rails 43, 44 when drawing the sheet cassette 4.

The inner bearings 45, 46 are rotatably supported by the inner rails 43, 44 at the back side X2 in the sliding direction X respectively having a rotational axis in the horizontal direction being perpendicular to the sliding direction X. The inner bearings 45, 46 assist movement of the inner rails 43, 44 in the sliding direction X as being rotated on the outer rails 53, 54. The inner spacers 47, 48 are attached to the back side X2 of the inner rails 43, 44 in the sliding direction X and are contacted to the later-mentioned outer rail 53, so that the cassette body 40 is guided in the sliding direction X and looseness at the time of attaching and detaching thereof is suppressed. That is, the inner spacers 47, 48 restrict movement of the cassette body 40 (sheet cassette 4) in the horizontal direction being perpendicular to the sliding direction X as being contacted to the outer rail 53.

As illustrated in FIG. 5, the apparatus body 5 includes a chassis 50 which accommodates the sheet cassette 4, the first positioning hole 51 and the second positioning hole 52 as a fitting hole of the positioning member, and the outer rails 53, 54 as the guide member of the restriction member. Further, the apparatus body 5 includes outer bearings 55, 56 and outer spacers 57, 58 as the guided member of the restriction member.

The chassis 50 is formed into a rectangular box shape of which front side X1 in the sliding direction X is opened. The first positioning hole 51 and the second positioning hole 52 are arrange at an upper face inside the chassis 50. The first positioning hole 51 is arranged at the front side X1 of the chassis 50 in the sliding direction X to enable the first positioning pin 41 to be fitted thereto. The second positioning hole 52 is arranged at the back side X2 of the chassis 50 in the sliding direction X to enable the second positioning pin 42 to be fitted thereto. In the first embodiment, owing to that the first positioning pin 41 is fitted to the first positioning hole 51 and the second positioning pin 42 is fitted to the second positioning hole 52, positioning of the sheet cassette 4 is performed at the attached position in the apparatus body 5. The fitted position is to be the attached position for the sheet cassette 4 to perform sheet feeding.

The outer rails 53, 54 are arranged at a lower face of the chassis 50 as being extended in the sliding direction X and guide the cassette body 40 (sheet cassette 4) to which the inner rails 43, 33 are fixed to the attached position. Further, second hole portions 60*a*, 60*b* are formed at the outer rails 53, 54 at the back side X2 in the sliding direction X as the release portion (see FIG. 8B described later). The second hole portions 60*a*, 60*b* are formed to have size of dimensions in the sliding direction X to prevent the inner spacers 47, 48 from being guided (restricted) by the outer rails 53, 54 in a range from the fitting beginning position where the first positioning pin 41 and the second positioning pin 42 begin fitting with the first positioning hole 51 and the second positioning hole 52 to the fitting completed position. That is, the size of the second hole portions 60*a*, 60*b* in the sliding direction X is set in accordance with the movement amount of the cassette body 40 from the fitting beginning position to the fitting completed position of the first and second positioning pins 41, 42 with the first and second positioning holes 51, 52. Slopes 53*a*, 53*b* are formed at the front side X1 in the sliding direction X from the second hole portions 60*a*, 60*b*. The slopes 53*a*, 53*b* are arranged as being expanded to the back side X2 in the sliding direction X so as to prevent the cassette body 40 from being locked as the inner spacers 47, 48 getting stuck with the outer rails 53, 54 when drawing the sheet cassette 4.

The outer bearings 55, 56 are rotatably supported by the outer rails 53, 54 at the front side X1 in the sliding direction X respectively having a rotational axis in the horizontal direction being perpendicular to the sliding direction X. The outer bearings 55, 56 assist movement of the inner rails 43, 44 in the sliding direction X as being rotated when engaged with the inner rails 43, 44. The outer spacers 57, 58 are attached to the front side X1 of the outer rails 53, 54 in the sliding direction X and are contacted to the inner rails 43, 44, so that the cassette body 40 is guided in the sliding direction X and looseness at the time of attaching and detaching thereof is suppressed. That is, the outer spacers 57, 58 restricts movement of the cassette body 40 (sheet cassette 4) in the horizontal direction being perpendicular to the sliding direction X as being contacted to the inner rails 43, 44.

Figure 6A:
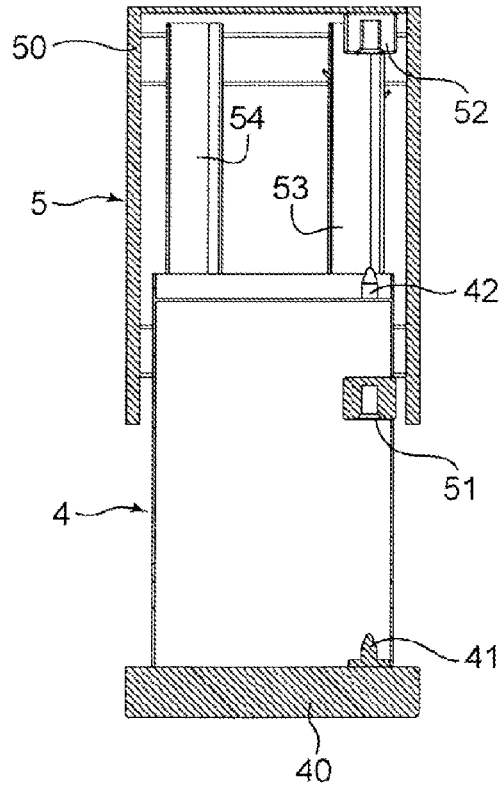
FIG. 6A is a sectional view at A-A illustrated in FIG. 3 in a state that the sheet cassette is drawn from the apparatus body according to the first embodiment.
Figure 6B:
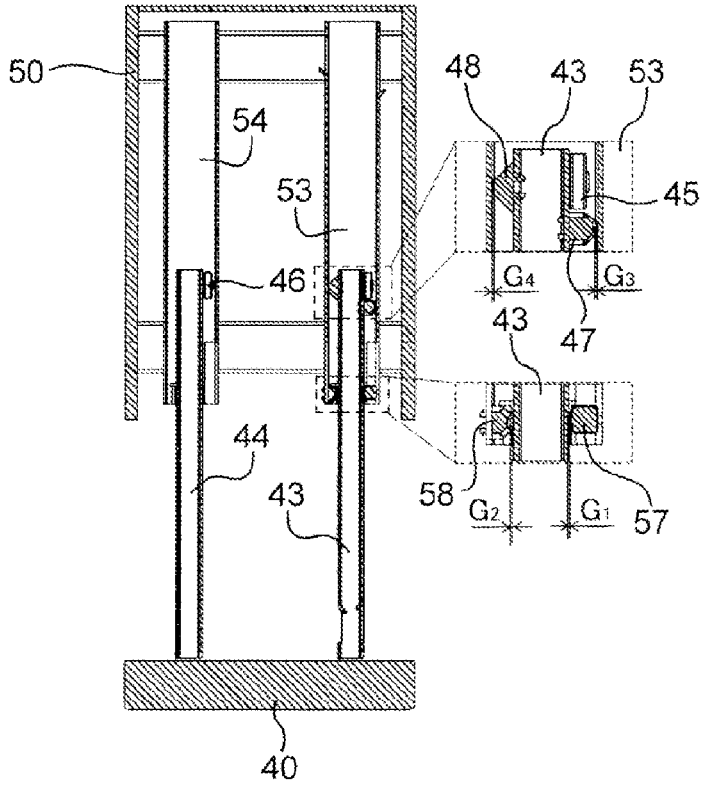
FIG. 6B is a sectional view at B-B illustrated in FIG. 3 in a state of FIG. 6A.
Figure 7A:
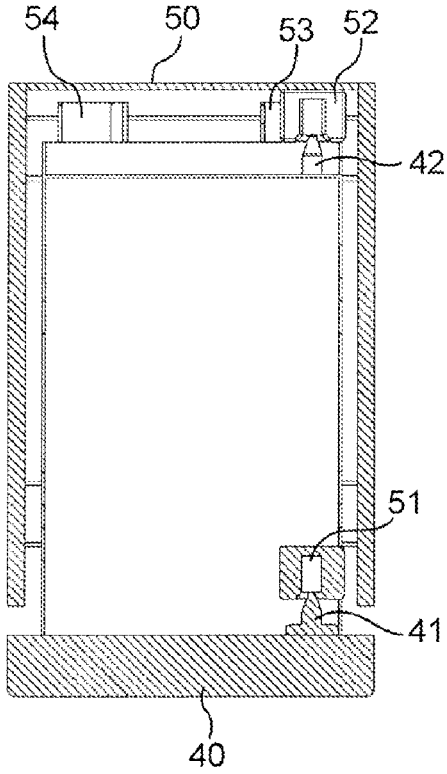
FIG. 7A is a sectional view at A-A illustrated in FIG. 3 in a state that the sheet cassette is about to be fixed to the apparatus body with positioning pins according to the first embodiment.
Figure 7B:
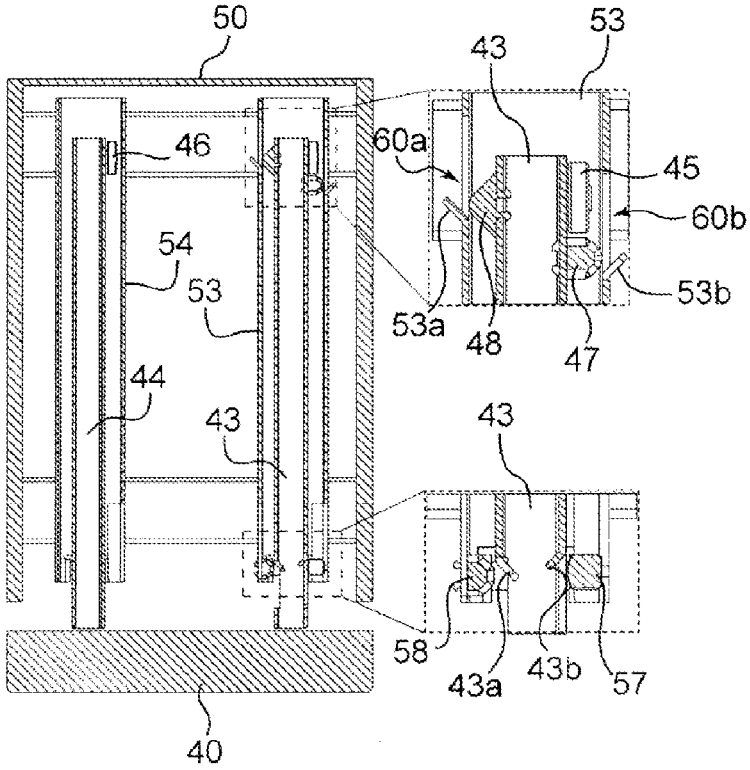
FIG. 7B is a sectional view at B-B illustrated in FIG. 3 in a state of FIG. 7A.
Figure 8A:
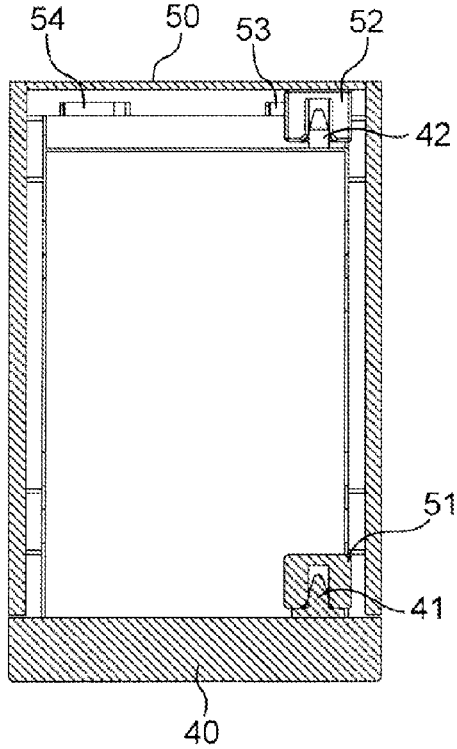
FIG. 8A is a sectional view at A-A illustrated in FIG. 3 in a state that the sheet cassette is fixed to the apparatus body with the positioning pins according to the first embodiment.
Figure 8B:
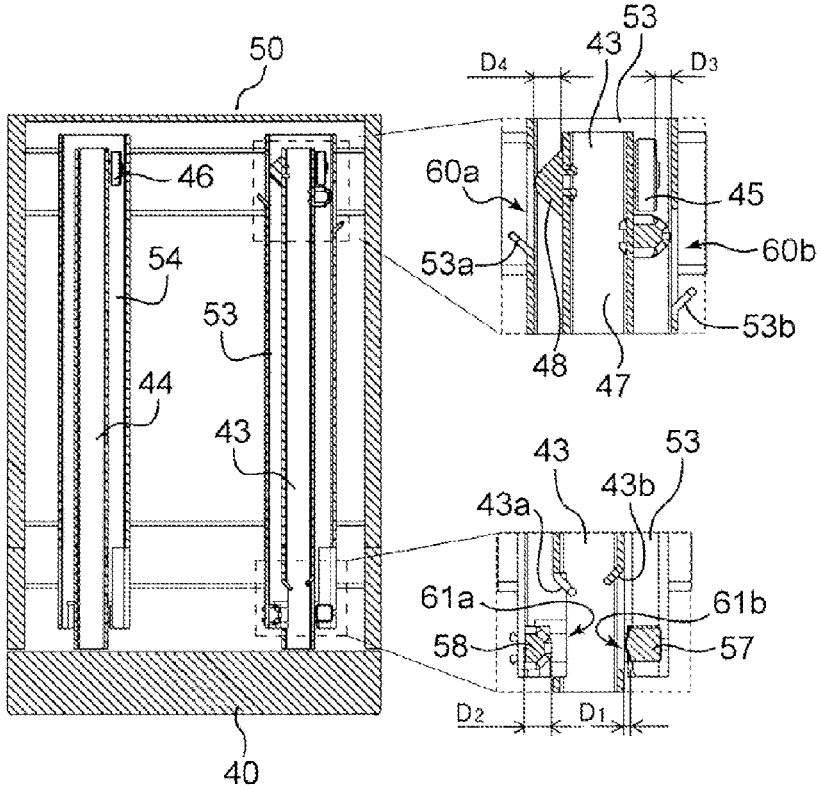
FIG. 8B is a sectional view at B-B illustrated in FIG. 3 in a state of FIG. 8A.

Next, description will be performed on clearances between the outer rail 53 and the inner spacers 47, 48 and clearances between the inner rail 43 and the outer spacers 57, 58 with reference to FIGS. 6A to 8B. FIG. 6A is a sectional view at A-A illustrated in FIG. 3 in a state that the sheet cassette 4 is drawn from the apparatus body 5 according to the first embodiment. FIG. 6B is a sectional view at B-B illustrated in FIG. 3 in a state of FIG. 6A. FIG. 7A is a sectional view at A-A illustrated in FIG. 3 in a state that the sheet cassette 4 is about to be fixed to the apparatus body 5 with the positioning pins according to the first embodiment. FIG. 7B is a sectional view at B-B illustrated in FIG. 3 in a state of FIG. 7A. FIG. 8A is a sectional view at A-A illustrated in FIG. 3 in a state that the sheet cassette 4 is fixed to the apparatus body with the positioning pins according to the first embodiment. FIG. 8B is a sectional view at B-B illustrated in FIG. 3 in a state of FIG. 8A.

When the sheet cassette 4 is at the drawn position (when the first positioning pin 41 and the second positioning pin 42 are at positions being apart from the first positioning hole 51 and the second positioning hole 52) as illustrated in FIG. 6A, the clearances are in a state as illustrated in FIG. 6B. Specifically, the clearance between the inner rail 43 and the outer spacer 57 is G1 and the clearance between the inner rail 43 and the outer spacer 58 is G2. Further, the clearance between the outer rail 53 and the inner spacer 47 is G3 and the clearance between the outer rail 53 and the inner spacer 48 is G4. In the first embodiment, since a parts count structuring the clearances G1, G2, G3, G4 is small, dimensional variation of the clearances G1, G2, G3, G4 becomes relatively small. Therefore, the clearances G1, G2, G3, G4 can be set to relatively small values. Accordingly, movement of the cassette body 40 (sheet cassette 4) in the horizontal direction being perpendicular to the sliding direction X can be reliably restricted, so that a rotation amount in the horizontal direction being perpendicular to the sliding direction X (direction Y illustrated in FIG. 14) in the process of attaching the sheet cassette 4 can be lessened. As a result, looseness at the time of attaching and detaching the cassette body 40 can be reliably suppressed. In addition, quality appearance is improved owing to looseness suppression.

Next, when the first positioning pin 41 and the second positioning pin 42 are about to begin fitting with the first positioning hole 51 and the second positioning hole 52 (at the fitting beginning position) as illustrated in FIG. 7A, the clearances are in a state as illustrated in FIG. 7B. Specifically, at the fitting beginning position, the first hole portions 61*a*, 61*b* appear at the inner rails 43, 44 and the second hole portions 60*a*, 60*b* appear at the outer rails 53, 54. That is, the inner spacers 47, 48 are not restricted (guided) by the outer rail 53 owing to the second hole portions 60*a*, 60*b* which are located at opposing positions. Similarly, the outer spacers 57, 58 are in a state of not being restricted (guided) by the inner rail 43 owing to the first hole portions 61*a*, 61*b* which are located at opposing positions. Accordingly, at the fitting beginning position, the first positioning pin 41 and the second positioning pin 42 can be fitted to the first positioning hole 51 and the second positioning hole 52 without being restricted by the inner spacers 47, 48 and the outer spacers 57, 58.

Similarly, as illustrated in FIGS. 8A and 8B, when the sheet cassette 4 is located between the fitting beginning position and the fitted position, the clearance between the inner rail 43 and the outer spacer 57 is D1 and the clearance between the inner rail 43 and the outer spacer 58 is D2. Further, the clearance between the outer rail 53 and the inner spacer 47 is D3 and the clearance between the outer rail 53 and the inner spacer 48 is D4.

As described above, in the first embodiment, the first hole portions 61*a*, 61*b* are formed at the inner rails 43, 44 and the second hole portions 60*a*, 60*a* are formed at the outer rails 53, 54 to prevent the clearances from vanishing even when variation occurs at components structuring the clearances D1, D2, D3, D4. With the above, in a range from the fitting beginning position to the fitted position, the inner rail 43 and the outer spacers 57, 58 are not contacted and the outer rail 53 and the inner spacers 47, 48 are not contacted as well.

Accordingly, friction force due to contact between the rails and spacers does not occur and fitting can be performed without being interfered with the rails and spacers. As a result, operational force at the time of attaching and detaching can be reduced.

Figure 14:
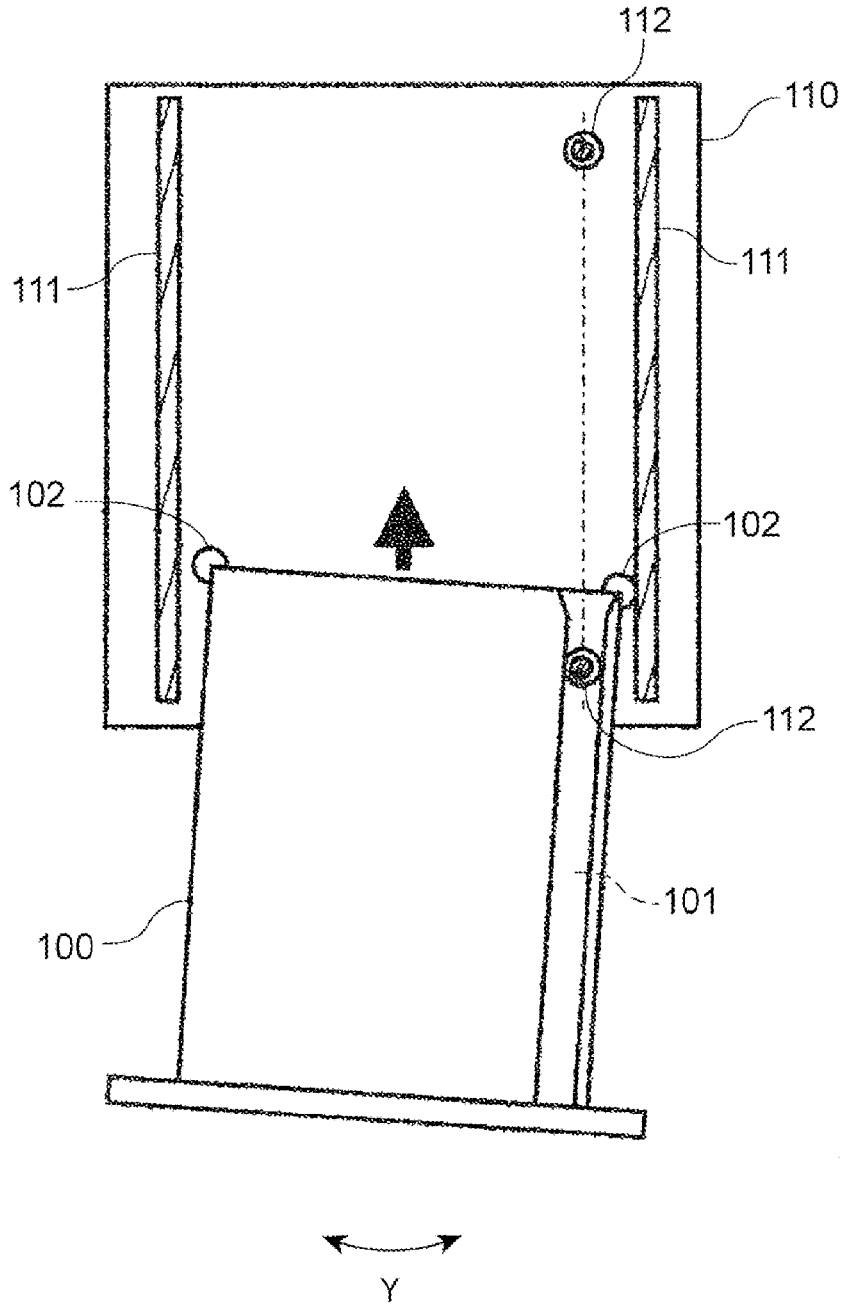
FIG. 14 PRIOR ART
FIG. 14 is a view illustrating a state that a sheet cassette is to be attached to a feeding apparatus body in a related art.

Further, owing to the structure that the first positioning pin 41 and the second positioning pin 42 are fitted to the first positioning hole 51 and the second positioning hole 52 at the time of fitting, positioning can be performed without being rotated in the horizontal direction being perpendicular to the sliding direction X (direction of arrow Y illustrated in FIG. 14).

In this manner, according to the sheet cassette 4 and the apparatus body 5 of the first embodiment, movement of the sheet cassette 4 in the horizontal direction can be reliably restricted without decreasing operability of the sheet cassette 4 when attaching the sheet cassette 4.

<Second Embodiment>Next, an image forming apparatus 1A according to a second embodiment of the present invention will be described with reference to FIGS. 9A to 13B as well as FIG. 1. The image forming apparatus 1A according to the second embodiment differs from that of the first embodiment in arranging position of a positioning pin, arranging of a positioning block, and arranging of a recess portion 43*c* at the inner rails 43, 44 instead of the first hole portions 61*a*, 61*b*. Accordingly, description of the second embodiment will be performed mainly on the points differing from the first embodiment, that is, the arranging position of the positioning pin, the positioning block, and the recess portion 43*c*. Here, the same numeral is given to a structure of the second embodiment similar to the image forming apparatus 1 according to the first embodiment and description thereof is skipped. In the second embodiment, the structure being similar to the first embodiment provides a similar effect as the first embodiment.

Figure 9A:
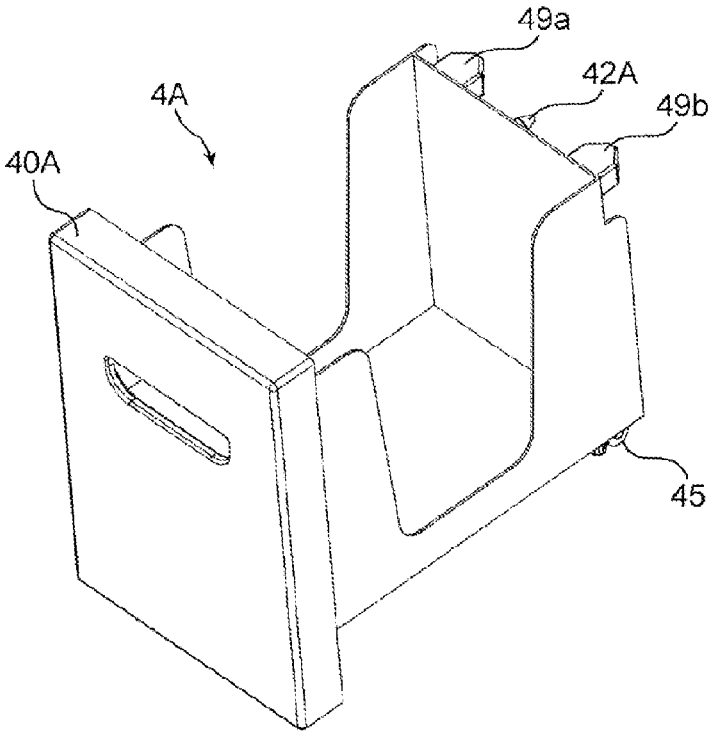
FIG. 9A is a perspective view of a sheet cassette according to a second embodiment viewing from above.
Figure 9B:
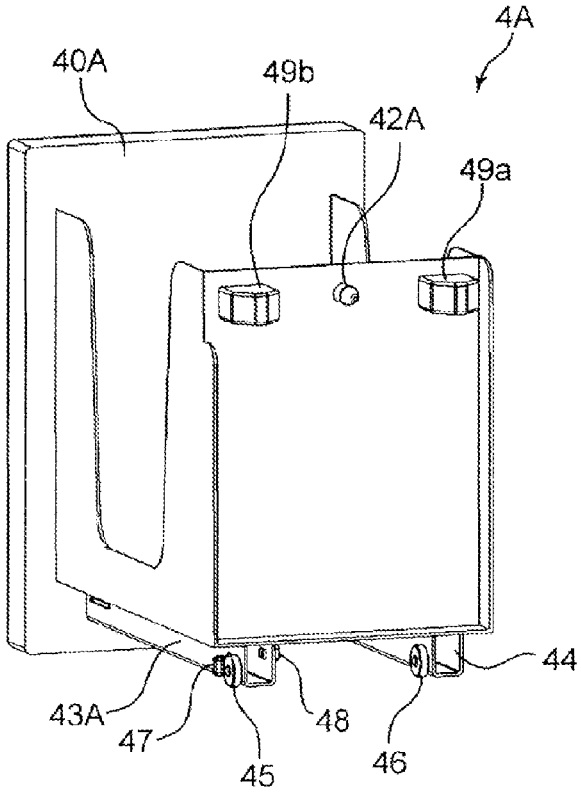
FIG. 9B is a perspective view of the sheet cassette viewing from behind.
Figure 10:
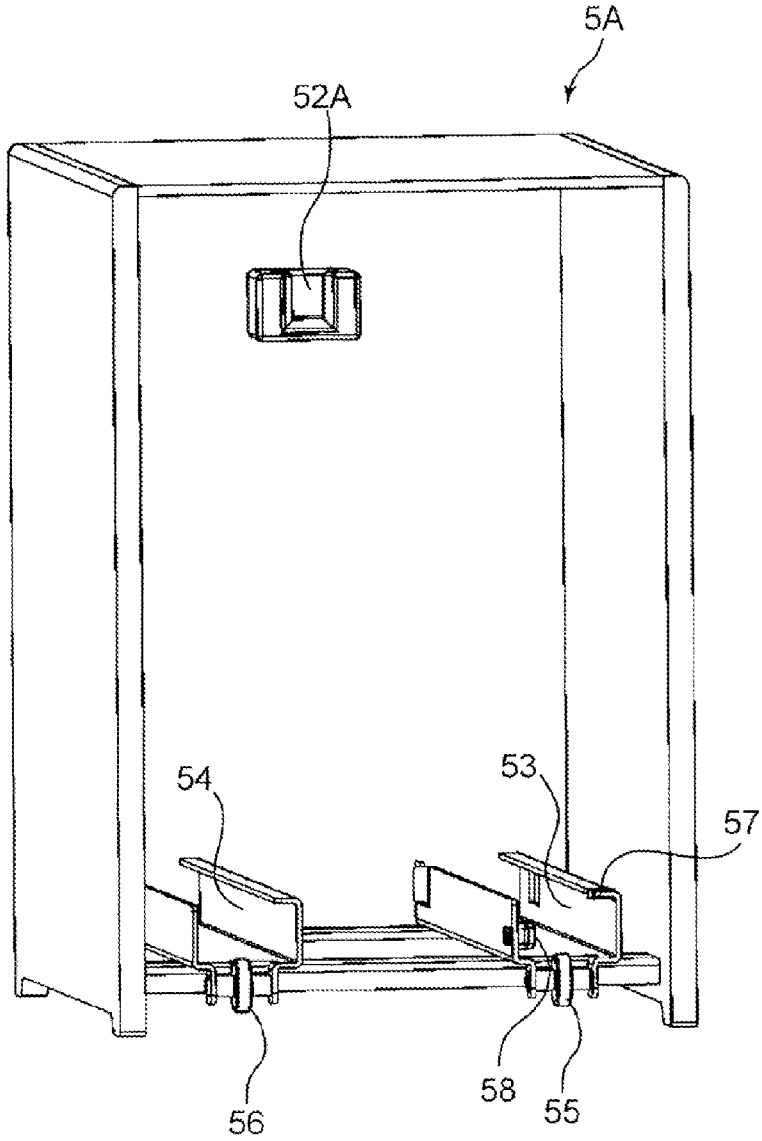
FIG. 10 is a perspective view schematically illustrating a part of an internal structure of an apparatus body according to the second embodiment.

First, an overall structure of the image forming apparatus 1A according to the second embodiment will be described with reference to FIGS. 9A to 10 as well as FIG. 1. FIG. 9A is a perspective view of a sheet cassette 4A according to the second embodiment viewing from above. FIG. 9B is a perspective view of the sheet cassette 4A viewing from behind. FIG. 10 is a perspective view schematically illustrating a part of an internal structure of an apparatus body 5A according to the second embodiment.

As illustrated in FIG. 1, the image forming apparatus 1A includes an image forming apparatus body 2 which forms an image on a sheet S and a sheet feeding apparatus 3A which feeds a sheet S to the image forming apparatus body 2. As illustrated in FIGS. 9A and 9B, the sheet cassette 4A includes a cassette body 40A, a positioning pin 42A, positioning blocks 49*a*, 49*b*, inner rails 43A, 44, inner bearings 45, 46, and inner spacers 47, 48. The positioning pin 42A is arranged at an approximate center part of the cassette body 40A at the back side X2 in the sliding direction X. The positioning blocks 49*a*, 49*b* are formed to be abutted to an inner wall of a chassis 50A at the fitted position as being arranged at both sides of the positioning pin 42A. A recess portion 43*c* is arranged at the inner rail 43A at the front side X1 in the sliding direction X as the release portion of the restriction member (see FIGS. 12B and 13B). The recess portion 43*c* is arranged as being expanded in a direction to be apart from the outer spacers 57, 58 so as to enlarge clearances against the outer spacers 57, 58 in a range from the fitting beginning position to the fitted position.

As illustrated in FIG. 10, the apparatus body 5A includes the chassis 50A, a positioning hole 52A, outer rails 53, 54, outer bearings 55, 56, and the outer spacers 57, 58. The positioning hole 52A is arranged at an upper face inside the chassis 50A. The positioning hole 52A is formed to enable the positioning pin 42A to be fitted thereto. In the second embodiment, owing to that the positioning pin 42A is fitted to the positioning hole 52A and the positioning blocks 49*a*, 49*b* are abutted to the chassis 50A, positioning of the sheet cassette 4A is performed at the attached position in the apparatus body 5. The fitted position is to be the attached position.

Figure 11A:
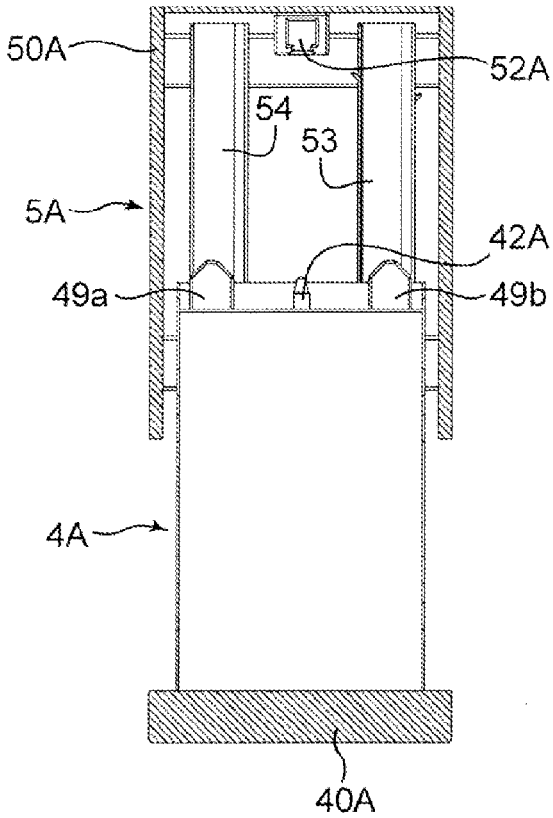
FIG. 11A is a sectional view at A-A illustrated in FIG. 3 in a state that the sheet cassette is drawn from the apparatus body according to the second embodiment.

Next, description will be performed on clearances between the outer rail 53 and the inner spacers 47, 48 and clearances between the inner rail 43A and the outer spacers 57, 58 with reference to FIGS. 11A to 13B. FIG. 11A is a sectional view at A-A illustrated in FIG. 3 in a state that the sheet cassette 4A is drawn from the apparatus body 5 according to the second embodiment. FIG. 11B is a sectional view at B-B illustrated in FIG. 3 in a state of FIG. 11A. FIG. 12A is a sectional view at A-A illustrated in FIG. 3 in a state that the sheet cassette 4A is about to be fixed to the apparatus body 5 with the positioning pin 42A according to the second embodiment. FIG. 12B is a sectional view at B-B illustrated in FIG. 3 in a state of FIG. 12A.

Figure 13A:
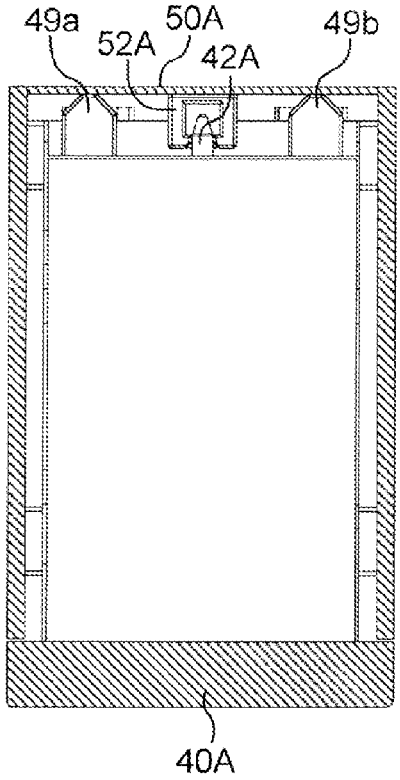
FIG. 13A is a sectional view at A-A illustrated in FIG. 3 in a state that the sheet cassette is fixed to the apparatus body with the positioning pin according to the second embodiment.
Figure 13B:
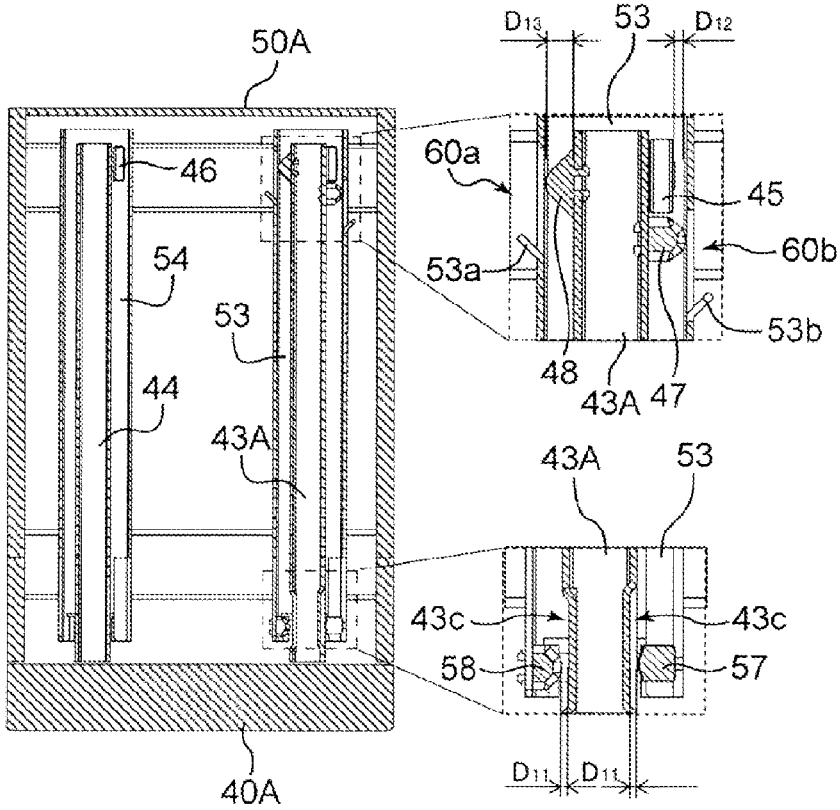
FIG. 13B is a sectional view at B-B illustrated in FIG. 3 in a state of FIG. 13A.

FIG. 13A is a sectional view at A-A illustrated in FIG. 3 in a state that the sheet cassette 4A is fixed to the apparatus body 5 with the positioning pin 42A according to the second embodiment. FIG. 13B is a sectional view at B-B illustrated in FIG. 3 in a state of FIG. 13A.

Figure 11B:
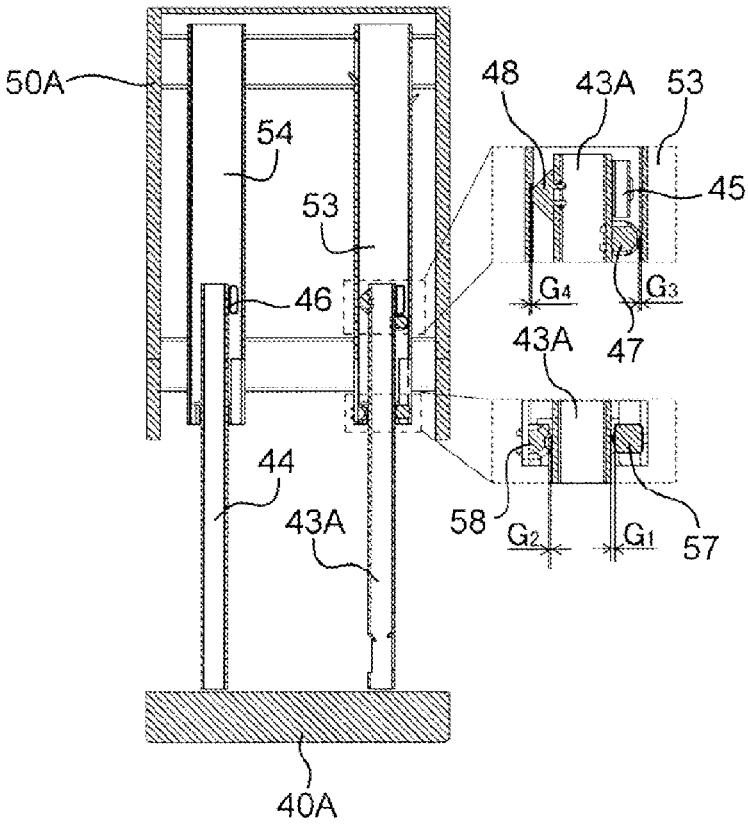
FIG. 11B is a sectional view at B-B illustrated in FIG. 3 in a state of FIG. 11A.
Figure 12A:
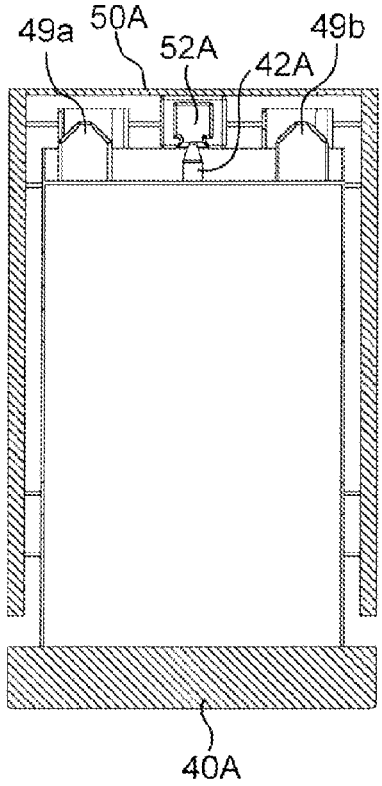
FIG. 12A is a sectional view at A-A illustrated in FIG. 3 in a state that the sheet cassette is about to be fixed to the apparatus body with a positioning pin according to the second embodiment.
Figure 12B:
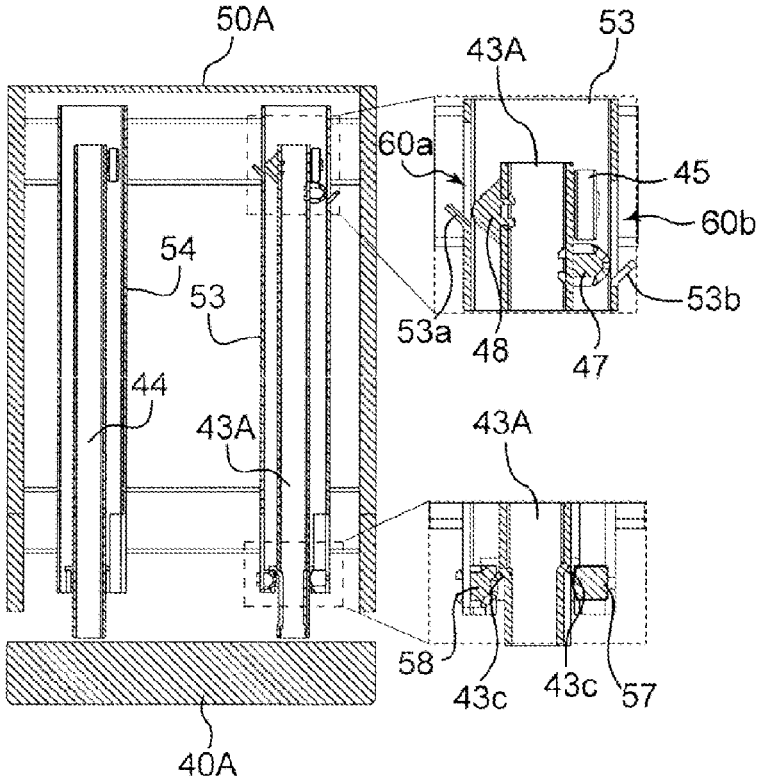
FIG. 12B is a sectional view at B-B illustrated in FIG. 3 in a state of FIG. 12A.

As illustrated in FIGS. 11A and 11B, the state in which the sheet cassette 4A is at the drawn position is similar to that of the first embodiment, description thereof is skipped. Next, as illustrated in FIGS. 12A to 13B, when the sheet cassette 4A is located between the fitting beginning position and the fitted position, the clearance between the inner rail 43A and the outer spacer 57 and the clearance between the inner rail 43A and the outer spacer 58 are D11. Further, the clearance between the outer rail 53 and the inner spacer 47 is D12 and the clearance between the outer rail 53 and the inner spacer 48 is D13.

In the second embodiment, the recess portion 43*c* is formed so as to enlarge the clearance between the inner rail 43A and the outer spacer 57 and the clearance between the inner rail 43A and the outer spacer 58. The recess portion 43*c* is formed to prevent the clearances D11 from vanishing even when dimensional variation occurs at the outer spacers 57, 58 and the like structuring the clearances D11. Similarly, the clearances D12, D13 are prevented by the second hole portions 60*a*, 60*b* from vanishing even when dimensional variation occurs at the inner spacers 47, 48 and the like.

Further, the clearances D11 are set to be smaller than the clearances D12, D13.

Accordingly, since movement in the horizontal direction is restricted, the sheet cassette 4A is prevented from being rotated in the direction of arrow Y illustrated in FIG. 14 even when a user touches the sheet cassette 4A located at the fitting beginning position, for example.

As described above, even in a case that the positioning member is localized at the back side X2 of the sheet cassette 4A in the sliding direction X as in the second embodiment, looseness of the sheet cassette 4A can be suppressed and quality appearance can be improved. Further, similarly to the first embodiment, friction force due to contact between the rails and spacers does not occur and fitting can be performed without being interfered with the rails and spacers. Accordingly operational force at the time of attaching and detaching can be reduced.

Further, in a case that stiffness of the sheet cassette is low, for example, looseness of the sheet cassette 4A can be suppressed without exerting influence on the operational force even when the inner rail 43A is set to be contacted to the outer spacer 57 and the outer spacer 58 (the clearance D11 is zero).

In the above, the embodiments of the present invention are described. Here, the present invention is not limited to the abovementioned embodiments.

Further, effects described for the embodiments of the present invention are only listed as preferable effects obtained with the present invention. Effects of the present invention are not limited to those described for the embodiments of the present invention.

For example, although the restriction member is structured by forming the first hole portion and the second hole portion at the inner rail and the outer rail as the release portion in the present embodiment, the present invention is not limited thereto. For example, the restriction member may be structured to release guiding (restriction) of the sheet cassette in the horizontal direction with a structure in which outer rail width is widened or inner rail width is narrowed when being at the fitting beginning position.

Further, although the guide member is arranged at the apparatus body and the sheet cassette and the guided member corresponding to the guide member is arranged at the apparatus body and the sheet cassette, the present invention is not limited thereto. For example, it is only required that a guide member is arranged at one of the apparatus body and sheet cassette and a guided member is arranged at the other of the apparatus body and the sheet cassette.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-167584, filed Jul. 29, 2011, which is hereby incorporated by reference herein in its entirety.

What is claimed is:

1. A sheet feeding apparatus, comprising:

an apparatus body;

a sheet cassette which stores sheets and is moved slidably between an attached position for feeding the sheet and a drawn position where the cassette is drawn from the apparatus body;

a positioning portion which includes a fitting projection, projected in a sliding direction of the sheet cassette, arranged at one of the apparatus body and the sheet cassette and a fitting hole arranged at a face being perpendicular to the sliding direction of the sheet cassette of the other of the apparatus body and the sheet cassette and which performs positioning of the sheet cassette to the apparatus body in a horizontal direction being perpendicular to the sliding direction of the sheet cassette to fit the fitting projection with the fitting hole when the sheet cassette is slidingly moved to the attached position from the drawn position; and a restriction portion which performs restriction of movement of the sheet cassette in the horizontal direction when the sheet cassette is slidingly moved from the drawn position to a fitting beginning position where fitting of the positioning portion begins and which releases restriction of the movement of the sheet cassette in the horizontal direction when the sheet cassette is slidingly moved from the fitting beginning position to the attached position.

2. The sheet feeding apparatus according to claim 1, wherein the restriction portion includes a guide member which is arranged at one of the apparatus body and the sheet cassette as being extended in the sliding direction, a guided member which is arranged at the other of the apparatus body and the sheet cassette as being slidably guided by the guide member and which restricts the movement of the sheet cassette in the horizontal direction with the guide member, and a release portion which releases guiding of the guided member by the guide member after the positioning portion begins fitting at the fitting beginning position while the sheet cassette is moved toward the attached position.

3. A sheet feeding apparatus, comprising:

an apparatus body;

a sheet cassette which stores sheets and is arranged slidably between an attached position for feeding the sheet and a drawn position where the cassette is drawn from the apparatus body;

a positioning portion which includes a fitting projection arranged at one of the apparatus body and the sheet cassette and a fitting hole arranged at the other of the apparatus body and the sheet cassette and which performs positioning of the sheet cassette to the apparatus body to fit the fitting projection with the fitting hole when the sheet cassette is slidingly moved to the attached position from the drawn position;

an outer rail which is arranged at the apparatus body;

an inner rail which is arranged at the sheet cassette as being located at the inner side from the outer rail and which slidably supports the sheet cassette by being moved along the outer rail;

an outer spacer which is arranged at the outer rail as being capable of contacting to the inner rail in the horizontal direction;

an inner spacer which is arranged at the inner rail as being capable of contacting to the outer rail in the horizontal direction;

a first hole portion or a recess portion which prevents contact with the outer spacer arranged at the outer rail as being formed at the inner rail at the front side from the sheet cassette in the sliding direction; and a second hole portion which prevents contact with the inner spacer arranged at the inner rail as being formed at the outer rail at a back side from the sheet cassette in the sliding direction.

4. The sheet feeding apparatus according to claim 3, wherein the second hole portion or the recess portion arranged at the inner rail is set to have size corresponding to a sliding movement amount of the sheet cassette from a position where the fitting projection begins fitting with the fitting hole to a position where the fitting is completed.

5. The sheet feeding apparatus according to claim 3, wherein the first hole portion or the recess portion arranged at the outer rail is set to have size corresponding to a sliding movement amount of the sheet cassette from a position where the fitting projection begins fitting with the fitting hole to a position where the fitting is completed.

6. The sheet feeding apparatus according to claim 3, wherein an outer bearing is arranged at the outer rail as being capable of rolling against the inner rail; and an inner bearing is arranged at the inner rail as being capable of rolling against the outer rail.

7. An image forming apparatus which forms an image at an image forming portion on a sheet fed from a sheet feeding apparatus, the sheet feeding apparatus comprising:

an apparatus body;

a sheet cassette which stores sheets and is arranged slidably between an attached position for feeding the sheet and a drawn position where the cassette is drawn from the apparatus body;

a positioning portion which includes a fitting projection, projected in a sliding direction of the sheet cassette, arranged at one of the apparatus body and the sheet cassette and a fitting hole arranged at a face being perpendicular to the sliding direction of the sheet cassette of the other of the apparatus body and the sheet cassette and which performs positioning of the sheet cassette to the apparatus body in a horizontal direction being perpendicular to the sliding direction of the sheet cassette to fit the fitting projection with the fitting hole when the sheet cassette is slidingly moved to the attached position from the drawn position; and a restriction portion which performs restriction of movement of the sheet cassette in the horizontal direction when the sheet cassette is slidingly moved from the drawn position to a fitting beginning position where fitting of the positioning portion begins and which releases restriction of the movement of the sheet cassette in the horizontal direction when the sheet cassette is slidingly moved from the fitting beginning position to the attached position.

8. The image forming apparatus according to claim 7, wherein the restriction portion includes a guide member which is arranged at one of the apparatus body and the sheet cassette as being extended in the sliding direction, a guided member which is arranged at the other of the apparatus body and the sheet cassette as being slidably guided by the guide member and which restricts the movement of the sheet cassette in the horizontal direction with the guide member, and a release portion which releases guiding of the guided member by the guide member after the positioning member begins fitting at the fitting beginning position while the sheet cassette is moved toward the attached position.

9. An image forming apparatus which forms an image at an image forming portion on a sheet fed from a sheet feeding apparatus, the sheet feeding apparatus comprising:

an apparatus body;

a sheet cassette which stores sheets and is arranged slidably between an attached position for feeding the sheet and a drawn position where the cassette is drawn from the apparatus body;

a positioning portion which includes a fitting projection arranged at one of the apparatus body and the sheet cassette and a fitting hole arranged at the other of the apparatus body and the sheet cassette and which performs positioning of the sheet cassette to the apparatus body to fit the fitting projection with the fitting hole when the sheet cassette is slidingly moved to the attached position from the drawn position;

an outer rail which is arranged at the apparatus body;

an inner rail which is arranged at the sheet cassette as being located at the inner side from the outer rail and which slidably supports the sheet cassette by being moved along the outer rail;

an outer spacer which is arranged at the outer rail as being capable of contacting to the inner rail in the horizontal direction;

an inner spacer which is arranged at the inner rail as being capable of contacting to the outer rail in the horizontal direction;

a first hole portion or a recess portion which prevents contact with the outer spacer arranged at the outer rail as being formed at the inner rail at the front side from the sheet cassette in the sliding direction; and a second hole portion which prevents contact with the inner spacer arranged at the inner rail as being formed at the outer rail at a back side from the sheet cassette in the sliding direction.

10. The image forming apparatus according to claim 9, wherein the second hole portion or the recess portion arranged at the inner rail is set to have size corresponding to a sliding movement amount of the sheet cassette from a position where the fitting projection begins fitting with the fitting hole to a position where the fitting is completed.

11. The image forming apparatus according to claim 9, wherein the first hole portion or the recess portion arranged at the outer rail is set to have size corresponding to a sliding movement amount of the sheet cassette from a position where the fitting projection begins fitting with the fitting hole to a position where the fitting is completed.

12. The image forming apparatus according to claim 9, wherein an outer bearing is arranged at the outer rail as being capable of rolling against the inner rail; and an inner bearing is arranged at the inner rail as being capable of rolling against the outer rail.

* * * * *

UNITED STATES PATENT AND TRADEMARK OFFICE

CERTIFICATE OF CORRECTION

PATENT NO. : 8,556,253 B2
APPLICATION NO. : 13/555498
DATED : October 15, 2013
INVENTOR(S) : Shunsuke Okazaki It is certified that error appears in the above-identified patent and that said Letters Patent is hereby corrected as shown below:

ON THE TITLE PAGE:

Correct the Assignee name as follows:

(73) ASSIGNEE:

"Canon Kabushikia Kaisha" should read --Canon Kabushiki Kaisha--

Signed and Sealed this
Fourth Day of February, 2014

Michelle K. Lee

Michelle K. Lee
*Deputy Director of the United States Patent and Trademark Office*